US010793413B2

(12) United States Patent
Cook et al.

(10) Patent No.: US 10,793,413 B2
(45) Date of Patent: Oct. 6, 2020

(54) COOLANT RECIRCULATION APPARATUS FOR A BEVERAGE DISPENSE SYSTEM

(71) Applicant: Cornelius Beverage Technologies Limited, West Yorkshire (GB)

(72) Inventors: Christopher Michael Cook, Worcestershire (GB); Mark William Bromwich, North Yorkshire (GB); Simon Anthony Felton, Worcestershire (GB)

(73) Assignee: Cornelius Beverage Technologies Limited, West Yorkshire (GB)

( * ) Notice: Subject to any disclaimer, the term of this patent is extended or adjusted under 35 U.S.C. 154(b) by 238 days.

(21) Appl. No.: 15/003,228

(22) Filed: Jan. 21, 2016

(65) Prior Publication Data

US 2016/0325979 A1 Nov. 10, 2016

(30) Foreign Application Priority Data

May 5, 2015 (GB) ..... 1507651.6
Sep. 8, 2015 (GB) ..... 1515906.4

(51) Int. Cl.
*F25D 17/02* (2006.01)
*B67D 1/08* (2006.01)
*F25D 31/00* (2006.01)

(52) U.S. Cl.
CPC ..... *B67D 1/0857* (2013.01); *B67D 1/0867* (2013.01); *F25D 31/002* (2013.01);
(Continued)

(58) Field of Classification Search
CPC ..... F25D 23/16; F25D 31/002; F25C 5/005; B67D 1/0857; B67D 1/0872;
(Continued)

(56) References Cited

U.S. PATENT DOCUMENTS 6,709,391 B2 * 3/2004 Mesaros ..... A61B 8/00 600/437
8,359,877 B2 * 1/2013 Kamen ..... B01D 1/0082 62/285

(Continued)

FOREIGN PATENT DOCUMENTS

EP 2295370 3/2011
EP 1876137 5/2013

(Continued)

OTHER PUBLICATIONS

European Extended Search Report, European Patent Application No. 16168452, date of completion Aug. 25, 2016.
European Search Report, GB1507651.6, dated Nov. 6, 2015.

*Primary Examiner* — Larry L Furdge
(74) *Attorney, Agent, or Firm* — Andrus Intellectual Property Law, LLP

(57) ABSTRACT

A coolant recirculation apparatus is for a beverage dispense system. The apparatus comprises a pump mechanism arranged to recirculate coolant via a coolant circuit from a coolant reservoir to a beverage dispense location having at least one dispense point at which beverage is dispensed; an agitation mechanism arranged to agitate coolant within the coolant reservoir; a data sensor arranged to sense temperature data associated with the coolant; and a control unit in communication with the pump mechanism, the agitation mechanism and the data sensor. The control unit is arranged to control the rate of operation of the agitation mechanism and the pump mechanism in response to the temperature data and according to a predefined property of the beverage dispense system.

40 Claims, 5 Drawing Sheets

(52) U.S. Cl.
CPC ..... *B67D 1/0872* (2013.01); *B67D 1/0884* (2013.01); *B67D 2210/00104* (2013.01)

(58) Field of Classification Search
CPC ..... B67D 1/0884; B67D 2210/00104; B67D 1/0864; B67D 1/0865
USPC ..... 62/389, 435
See application file for complete search history.

(56) References Cited

U.S. PATENT DOCUMENTS

| | | | | |
|---|---|---|---|---|
| 8,511,105 | B2 * | 8/2013 | Kamen ..... | B01D 1/28 62/285 |
| 2003/0071060 | A1 | 4/2003 | Haskayne et al. | |
| 2008/0276641 | A1 | 11/2008 | Wolske et al. | |
| 2010/0269707 | A1 | 10/2010 | Wiemer et al. | |

FOREIGN PATENT DOCUMENTS

| | | |
|---|---|---|
| EP | 2295369 | 4/2016 |
| GB | 2317680 | 4/1998 |
| GB | 2 440 329 | 1/2008 |
| GB | 2446312 | 2/2009 |
| GB | 2419176 | 4/2009 |
| GB | 2448621 | 4/2010 |
| GB | 2 465 632 | 6/2010 |
| GB | 2502631 | 12/2013 |
| GB | 2488827 | 7/2014 |
| GB | 2538114 | 11/2016 |
| IE | S70737 | 12/1996 |

* cited by examiner

COOLANT RECIRCULATION APPARATUS FOR A BEVERAGE DISPENSE SYSTEM

CROSS REFERENCE TO RELATED APPLICATIONS

This application claims the benefit of and priority to British Patent Application No. 1515906.4, filed Sep. 8, 2015 which is a divisional of British Patent Application No. 1507651.6, filed May 5, 2015. Both British applications are incorporated herein by reference.

FIELD

The present disclosure relates to a coolant recirculating apparatus for a beverage dispense system. The beverage dispense system may in particular be a system for dispensing draught beverages (such as beer or the like) where the beverage is stored and cooled at a storage location (such as a cellar), before being conducted to a dispense location (such as a bar where drinks are to be served) to be dispensed.

BACKGROUND

Beverage dispense systems are known to employ a cooler at a location remote from the dispense location. The cooler may comprise a coolant reservoir having the evaporator of a refrigeration system adjacent to its internal walls and one or more product coils, all of which are normally submerged in the coolant. In operation, an ice bank is formed on the evaporator to a predetermined thickness and heat transferred to the coolant from beverage passing through the product coils is dissipated by melting the ice bank. The water is agitated in order to aid heat transfer and maintain an even temperature within the water tank. An agitator is provided to agitate the coolant within the coolant reservoir and distribute heat via the coolant to the ice bank.

Beverage is conveyed to the dispense location via one or more product tubes contained within an insulated sheath commonly known in the art as a 'python'. In addition to the product tubes, chilled coolant is pumped through tubes also contained within the python. The coolant tubes run from the cooler to the dispense location through the python and return back through the python to the cooler, thus forming a coolant circuit. A pump is typically provided to pump coolant around the coolant circuit.

At the dispense location one more dispense points are provided to dispense beverage. The dispense points may be condensing fonts as are known in the art. Such condensing fonts are provided with coolant to cool a surface visible to the customer such that ice or condensation is formed on that surface. This is generally accepted as creating the perception of a beverage that is both cold and refreshing and, therefore, more appealing to the customer. Such condensing fonts place a high energy demand on the dispense system in order to maintain a suitable level of visible ice or condensation.

Prior art beverage dispense systems described above suffer from high-energy consumption. Energy losses may in particular be caused by motor power consumption, work done on the coolant by the pump impeller(s), coolant reservoir losses due to constant high agitation and excess capacity being provided to the python to achieve chilling performance. Furthermore, life expectancy of the mechanical components (e.g. pump/agitator/motor combination) employed for the task can be reduced by excess or inefficient use, which may result in breakdown of the system.

SUMMARY

A coolant recirculation apparatus is for a beverage dispense system. The apparatus comprises a pump mechanism arranged to recirculate coolant via a coolant circuit from a coolant reservoir to a beverage dispense location having at least one dispense point at which beverage is dispensed; an agitation mechanism arranged to agitate coolant within the coolant reservoir; a data sensor arranged to sense temperature data associated with the coolant; and a control unit in communication with the pump mechanism, the agitation mechanism and the data sensor. The control unit is arranged to control the rate of operation of the agitation mechanism and the pump mechanism in response to the temperature data and according to a predefined property of the beverage dispense system.

An intelligent control unit is arranged to control the pump mechanism and agitator mechanism according to changes in temperature of the coolant and such that it is optimised for the particular beverage dispense system with which it is being used. This ensures that the operation of the pump and agitator can be minimised to reduce energy consumption, whilst still ensuring effective performance of the beverage system.

Optionally, a change in temperature of either or both of the temperature of the coolant in the coolant reservoir and the temperature of the coolant returning to the coolant reservoir results in a change in the rate of operation of the pump mechanism and the agitator mechanism. This means that the coolant recirculation apparatus provides a rapid response to a surge in demand for beverage by reacting to either a change in temperature of the coolant in the reservoir or a change in the temperature of the coolant returning to the reservoir.

Optionally, the control unit is arranged to control the rate of operation of the pump mechanism and/or the agitator mechanism according to a control algorithm such that the rate of operation is matched to a change in demand for beverage at the dispense location. This helps to ensure that a change in demand for beverage is responded to appropriately. For example, a surge in demand for beverage may cause an increase in the amount of cooling required. However, sufficient cooling must be provided without over-reacting to the surge in demand, which would otherwise lead to unnecessary energy usage of the coolant recirculation apparatus.

Optionally, the control algorithm is such that the control unit is arranged to vary the rate of operation of the pump mechanism and/or the agitator mechanism in a range between a maximum rate and a minimum rate according to the magnitude of a change in temperature of the coolant. This means that a proportional response is provided to a change in temperature of the coolant. As a result, the pump and/or agitator are not constantly switched between a minimum and maximum rate of operation thus reducing energy consumption.

Optionally, the data sensor comprises a single temperature sensor arranged to sense the temperature of the coolant returning to the coolant reservoir via the coolant circuit and the temperature of the coolant in the coolant reservoir. This means that a single critically located temperature sensor is able to provide temperature data associated with both the temperature of the coolant in the reservoir and returning to the reservoir.

Optionally, the data sensor comprises a first temperature sensor arranged to sense the temperature of the coolant returning to the coolant reservoir via the coolant circuit and a second temperature sensor arranged to sense the temperature of the coolant in the coolant reservoir.

Optionally, the predefined property of the beverage dispense system comprises the number of dispense points that comprise a condensing font. This means that the control means is arranged to adapt the operation of the coolant recirculation apparatus according to the particular dispense system it is attached to. This reduces the energy consumption of the coolant recirculation apparatus by tailoring the demand for coolant to the number of dispense points the system must supply with coolant that comprise condensing fonts.

Optionally, the control means is arranged to control the operation of the pump such that a threshold coolant pressure is provided in the coolant circuit. This ensures that a minimum pressure is provided to ensure adequate function of the beverage dispense system. The threshold coolant pressure can be tailored to the number of dispense points that comprise condensing fonts to provide efficient function of the condensing fonts while reducing energy consumption.

Optionally, the dispense points comprise condensing fonts and the threshold pressure is sufficient to provide cooling to a condensing surface of the, or each, condensing font. This ensures that adequate coolant is provided to ensure condensation or ice is produced on a visible surface of the condensing font.

Optionally, the coolant recirculation apparatus may further comprise a user input means arranged to receive an input specifying the number of condensing fonts attached to the coolant circuit. This allows the number of condensing fonts to be selected when the coolant recirculation apparatus is installed or at a later time if the number of condensing fonts is changed.

Optionally, the input means may comprise a selector switch. This provides a convenient means for the user (or installer) of the system to select the number of condensing fonts. In other embodiments, another form of user input means may be provided such as a control panel, touch sensitive display or the like.

Optionally, the control unit may be arranged to provide an idle mode. In the idle mode energy consumption is reduced by reducing the function of the coolant recirculation apparatus when it is not required.

Optionally, in the idle mode the coolant recirculation in the coolant circuit is sufficient to maintain beverage cooling. This reduces the overall energy consumption of the recirculation apparatus.

Optionally, the coolant recirculation in the coolant circuit in the idle mode can be sufficient to maintain condensation or ice formation on the at least one condensing font attached to the coolant circuit.

Optionally, in the idle mode the pump mechanism, the agitation mechanism or both are operated at a predetermined minimum rate. The minimum predetermined rate is chosen to ensure adequate cooling, while minimising energy wasted on creating condensation at the fonts.

Optionally, the coolant recirculation apparatus further comprises a user input means in communication with the control unit, the user input means arranged to receive an input selecting the idle mode. In some embodiments, the user input means may be the same as that which is provided to select the number of condensing fonts attached to the coolant circuit. This provides a convenient method of allowing the user to manually activate the idle mode.

Optionally, the coolant recirculation apparatus may further comprise a timing means in communication with the control unit, the timing means arranged to activate the idle mode at a predetermined time. This allows the idle mode to be automatically initiated at a certain time without the need for a user input. In some embodiments, a memory may be provided to store a user defined schedule of times at which the idle mode is to be started and stopped.

Optionally, the control unit may be arranged to provide a freeze point suppressant mode in which the rate of operation of the agitation mechanism and the pump mechanism are modified to account for the presence of a freeze point suppressant within the coolant. This may allow the operation of the coolant recirculation apparatus to be tailored for use with system that does, or does not, use a freeze point suppressant.

Optionally, the control unit may be arranged to control the rate of operation of the agitation mechanism and the pump mechanism at: a first set of predetermined values corresponding to a normal mode in which the coolant does not comprise a freeze point suppressant; and a second set of predetermined values corresponding to the freeze point suppressant mode in which the coolant does comprise a freeze point suppressant. This allows an appropriate set of values for the rate of operation to be chosen according to the type of coolant.

Optionally, the freeze point suppressant mode may be arranged to apply an offset to the temperature data in order to allow the operation of the agitation mechanism and the pump mechanism to be controlled at the second set of predetermined values. This allows the coolant to operate at a lower temperature, e.g. below zero degrees, where a freeze point suppressant is being used.

Optionally, the coolant recirculation apparatus may further comprise a user input means arranged to receive an input selecting the freeze point suppressant mode. In some embodiments, the user input means may be the same as that which is provided to select the number of condensing fonts attached to the coolant circuit or to select the idle mode.

Optionally, the user input means may be provided by a keypad located at the control unit.

In another aspect, the present disclosure provides an integrated coolant recirculation assembly comprising the pump mechanism, agitation mechanism, data sensor and control unit described above. By providing an integrated unit the recirculation assembly can be retro-fitted to an existing system quickly, safely and with application certainty.

A coolant recirculation apparatus is arranged to provide coolant to one or more condensing fonts at which beverage is dispensed, the apparatus comprising any one or more of the following features: a pump mechanism arranged to recirculate coolant via a coolant circuit from a coolant reservoir to the condensing fonts; an agitation mechanism arranged to agitate coolant within the coolant reservoir; a data sensor arranged to sense temperature data associated with the coolant; and a control unit in communication with the pump mechanism, the agitation mechanism and the data sensor, wherein the control unit is arranged to control the rate of operation of the agitation mechanism and the pump mechanism in response to the temperature data and according to the number of condensing fonts.

In another aspect, an integrated pump and agitator unit for a beverage cooler comprises a pump for circulating coolant between the cooler and a remote dispense location, an agitator for agitating coolant within the cooler, a motor for driving the pump and agitator, a data sensor arranged to sense temperature data associated with the coolant, and a control unit in communication with the motor and the data sensor, wherein the control unit is arranged to control the motor to vary the pump speed and agitator speed in response to the temperature data and according to the number of condensing fonts at the remote dispense location.

The unit may be fitted in a new cooler or retrofitted in an existing cooler, for example to upgrade and improve performance and energy efficiency of an existing cooler.

The unit may include a selector for inputting the number of condensing fonts supplied by the cooler and the control unit may be arranged to control the motor in response to selection of the number of condensing fonts.

In another aspect the coolant recirculation apparatus for a beverage dispense system, comprises a pump mechanism arranged to recirculate coolant via a coolant circuit from a coolant reservoir to a beverage dispense location having at least one dispense point at which beverage is dispensed; a data sensor arranged to sense temperature data associated with the coolant; and a control unit in communication with the pump mechanism and the data sensor, wherein the control unit is arranged to control the rate of operation of the pump mechanism in response to the temperature data and according to a predefined property of the beverage dispense system.

The predefined property may comprise the number of dispense points that comprise a condensing font. A user input means may be arranged to receive an input specifying the number of condensing fonts attached to coolant circuit. The input means may comprise a selector switch. The control means may be arranged to control the operation of the pump such that a threshold coolant pressure is provided in the coolant circuit. The threshold pressure may sufficient to provide cooling to a condensing surface of the or each condensing font. The control means may be responsive to input of the number of condensing fonts attached to the cooling circuit to adjust the operation of the pump to provide cooling to all the condensing fonts attached to the cooling circuit. The pump speed may be adjustable in response to user selection of the number of condensing fonts to provide cooling to all the condensing fonts attached to the cooling circuit. The apparatus may further include an agitator mechanism arranged to agitate coolant within the coolant reservoir. The pump mechanism and agitator mechanism may be combined. The pump mechanism and agitator mechanism may be driven by a common motor. The pump mechanism and agitator mechanism may be separate. The pump mechanism and agitator mechanism may be driven by separate motors.

BRIEF DESCRIPTION OF THE DRAWINGS

Embodiments will now be described, by way of example only, with reference to the accompanying drawings, in which.

DETAILED DESCRIPTION OF THE DRAWINGS

Figure 1:
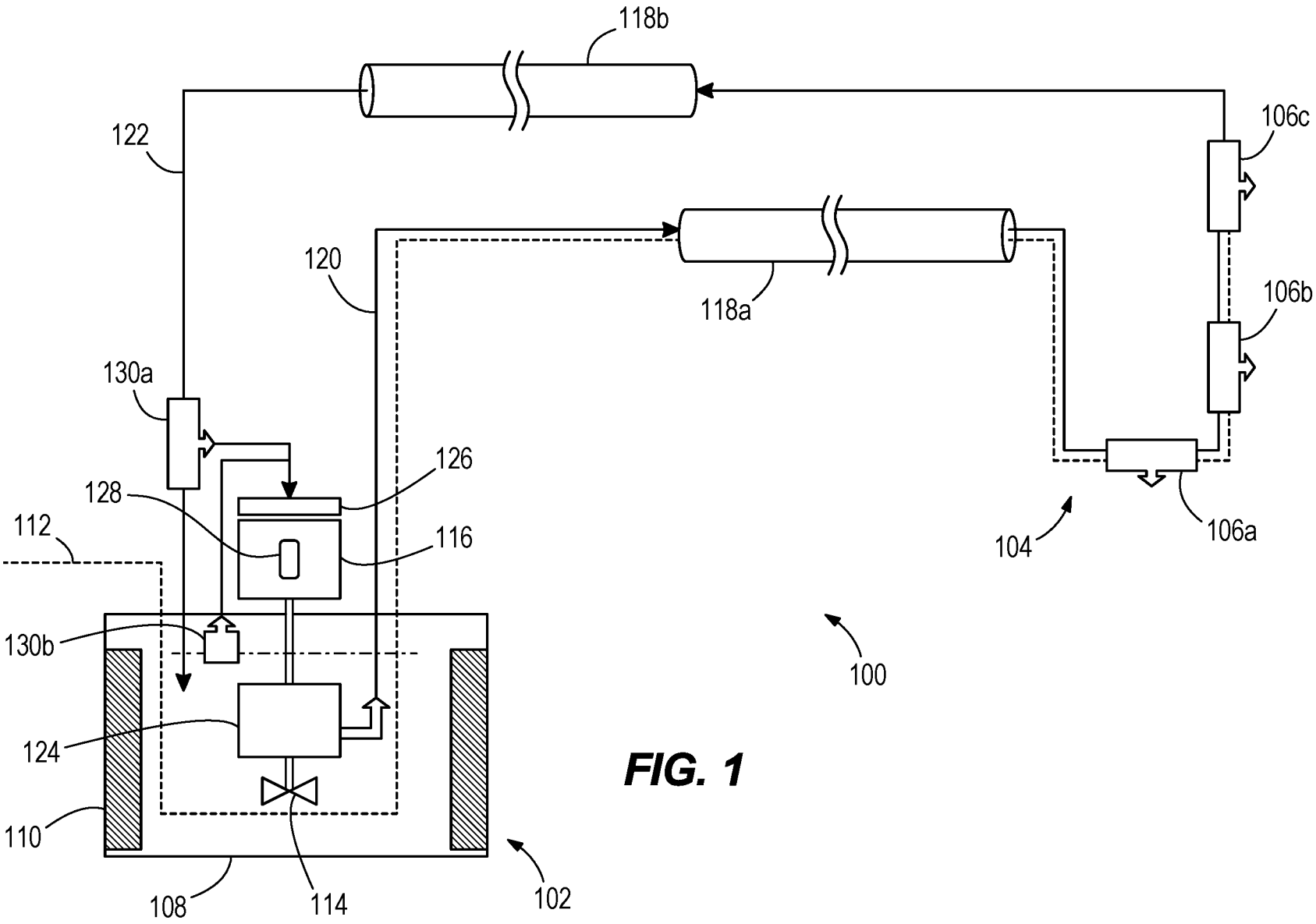
FIG. 1 shows a schematic view of a beverage dispense system comprising a coolant recirculation apparatus according to one embodiment.

Referring to FIG. 1, a beverage dispense system 100 includes a beverage cooler 102 located remotely from a dispense location 104 at which one or more beverage dispense points 106*a*, 106*b*, 106*c* are provided (three of which are shown as an example only in FIG. 1). The beverage cooler 102 comprises a coolant reservoir 108 having around its internal walls an evaporator 110 of a refrigeration system (not shown in FIG. 1). The coolant reservoir 108 is arranged to hold a coolant which in the described embodiment may be water. In some embodiments, the coolant may contain a freeze point suppressant such as glycol. In some embodiments, the coolant may contain additives such as corrosion inhibitors. Any other coolant known in the art may be employed in the coolant circuit. The refrigeration system causes an ice bank to form on the evaporator 110 from the water content of the coolant of the coolant reservoir 108 as is known in the art.

One or more product lines 112 containing beverage pass from a beverage storage source (not shown in FIG. 1) through the beverage cooler 102 such that the beverage line 112 is submerged in the coolant. Heat from the beverage in the product line 112 is conducted to the ice bank via the coolant to cool the beverage. The coolant within the reservoir 108 is agitated using an agitator mechanism 114 that is driven by a motor 116. In the described embodiment, the agitator mechanism comprises a rotating impeller arranged to provide a flow of coolant within the reservoir 108. In other embodiments, the agitator mechanism 114 may be any other mechanism suitable to cause movement of the coolant within the reservoir 108. The motor 116 may be variable in speed to drive the agitator mechanism 114 at different rates (e.g. operate the agitator at different rates of operation). In some embodiments, the motor speed may vary between a set of discrete speeds or may vary continuously. The agitator 114 provides a flow of coolant over the ice bank in order to improve hear transfer from the beverage within the product line 112 to the ice bank.

Beverage flows from the beverage cooler 102 to the dispense location 104 via the product line 112 as shown schematically in FIG. 1. The product line 112 is contained within an insulated bundle of tubes commonly referred to as a python 118 in the art. The python 118 may contain any number of product lines 112 although in the described embodiment the python contains only one such product line 112 as shown in FIG. 1. In addition to the product line 112, also contained within the python 118 is a flow line 120 which conducts coolant from the reservoir 108 to the dispense location 104 and a return line 122 which conducts coolant from the dispense location 104 to the reservoir. The flow line 120 and return line 122 form a coolant circuit. Coolant is conducted around the coolant circuit by a pump 124. In the described embodiment, the pump 124 is driven by the motor 116, so that any change in speed of the pump 124 causes a corresponding change in speed of the agitator 114. In the described embodiment, a single drive shaft is provided to drive both the pump 124 and agitator 114, but in other embodiments a different drive mechanism can be provided such as separate drive shafts. In yet other embodiments, separate motors may be provided to drive the agitator 114 and the pump 124 independently. The motor 116 may be varied in speed to provide variable pumping rates of coolant around the coolant circuit. In some embodiments, the agitator may be omitted.

At the dispense location 104 a number of dispense points 106*a*, 106*b*, 106*c* are provided. In the described embodiment, the dispense points 106*a*, 106*b*, 106*c* each comprise a condensing dispense head or font (e.g. to form a thermally active dispense point or condensing font). Each dispense head is arranged to receive coolant from the python 118 such that all or part of its surface is reduced in temperature below the dew point allowing moisture in the ambient air to condense on the cooled surface. The condensation that forms on this condensing surface may in some embodiments freeze to form ice depending on the temperature of the coolant provided to the dispense point 106*a*, 106*b*, 106*c*. The number of condensing fonts may vary. In some embodiments, all the dispense points may comprise condensing fonts. In other embodiments the dispense points may include both condensing and non-condensing fonts. In other embodiments, all the dispense points may be non-condensing fonts.

The beverage dispense system 100 further comprises a control unit 126 arranged to control the operation of the agitator 114 and the pump 124. The control unit 126 may be arranged to control the speed of the motor 116 in order to control the speed at which the pump 124 is driven and thereby control the rate of flow of coolant through the coolant circuit. The control unit may be additionally or alternatively arranged to control the pump 124 and agitator according to a predefined property of the dispense system as will be described later. By controlling the speed of the motor 116, the speed at which the agitator 114 is driven is also changed. By changing the rate at which the agitator 114 is driven, the rate at which coolant flows over the ice bank is changed. This changes the rate at which heat is transferred from the beverage to the ice bank.

The control unit 126 may be directly mounted on the pump/motor assembly, or may in other embodiments be a separate unit in communication with the pump/motor assembly. Communication may be provided by any suitable means including but not limited to a wired link or a wireless link.

The invention of this application provides an intelligent control unit 126 which is arranged to control the motor 116 (and thereby control the pump 124 and agitator 114) to improve the efficiency of the beverage dispense system and reduce energy consumption.

In order to improve the efficiency of the beverage dispense system 100, the control unit 126 is arranged to control the pump 124 and the agitator 114 such that the pressure of coolant is suitable for the number and/or type of dispense points 106*a*, 106*b*, 106*c* provided at the dispense location 104. The condensing fonts (i.e. thermally active dispense points) provided at the dispense location 104 require a minimum threshold level of coolant pressure to be available from the flow line 120 in order to attain the desired level of condensation. The minimum threshold pressure of coolant will depend on the number of condensing fonts supplied by the coolant circuit. As the number of condensing fonts may vary from system to system depending on the particular implementation, the coolant supplied by the coolant circuit must be controlled accordingly. A greater number of condensing fonts will for example require a greater pressure of coolant to sustain the required condensation levels in comparison to a small number of dispensing fonts. The control unit 126 is arranged to control the rate of operation of the pump 124 and agitator 114 (via control of the speed of the motor 116) such that it is tailored to the number of condensing fonts. A multiple thermally active dispense points mode may therefore be provided in which the pump and agitator are controlled according to the number of thermally active dispense points (i.e. condensing fonts) connected to the system. The control unit may therefore be arranged to control the rate of operation of the pump 124 and/or the agitator 114 at a minimum threshold that is determined according to the number of condensing fonts attached to the coolant circuit. For example, the minimum threshold may be greater where the number of condensing fonts connected to the coolant circuit is greater.

The dispense system 100 may further comprise a user input means 128 such as a selector switch or control panel which is arranged to receive an input specifying the number of condensing fonts supplied by the coolant circuit. The number of condensing fonts may be selected when the system is installed, or at a later time if the system is modified to include more or fewer condensing fonts. In some embodiments, a multiple dispense point mode may be provided in which a minimum rate of operation of the pump and/or agitator is set to a predetermined level arranged to correspond to a particular number of dispense points (or condensing fonts). This may allow quick switching between use with a single dispense point (or condensing font), or with a particular number of dispense points (or condensing fonts). The multiple dispense point mode may be selected by the user input means 128.

The control unit 126 may additionally or alternatively be arranged to provide an idle mode for the dispense system 100. When outside of trading periods (e.g. overnight), the system may not be required to deliver product to the dispense location 104. In order to keep energy consumption to a minimum, it is known to simply switch off the beverage cooler 102 or pump 124. This however has the drawback of any product remaining in the product line 112 being allowed to warm up which, in some cases, may lead to degradation of the product. Once the system has been switched off, restarting it when trading recommences can reduce the effectiveness of the system and may be energy inefficient. Similarly, leaving the system running constantly is also energy inefficient and should be avoided. This is especially the case for condensing fonts which may require a large amount of energy to maintain condensation levels.

In order to alleviate this drawback, the control unit 126 is arranged to provide an idle mode in which a reduced temperature is maintained in the python 118 whilst condensation at the, or each, of the condensing fonts is kept to a minimum. This balances the need to keep the product remaining in the product line 112 cool to prevent degradation, whilst avoiding using large amounts of energy to unnecessarily produce condensation at the condensing font. In the idle mode, cooling to the python and condensing fonts may be maintained so as to reduce the amount of energy required to reactivate the system once the idle mode is switched off. This reduces the overall energy consumption of the system. The control unit 126 may be arranged to receive a manual input by the user (via the same or a different input means used to select the number of dispensing fonts, for example) which specifies that the idle mode should be activated. In other embodiments, a timer may be provided to provide a signal to the control unit 126 to activate the idle mode at a predetermined time (e.g. the time at which trading is expected to end). The idle mode may provide a full energy saving mode in which the operation of other modes of the controller (e.g. the multiple dispense points or freeze point suppressant mode) may be over-ridden if the operation of the pump 124 and/or agitator 114 exceeds a predetermined threshold. This may allow the lowest energy operation of the pump and/or agitator to be selected.

The control unit 126 is further arranged to control the rate of operation of the pump 124 and the agitator 114 in response to temperature data associated with the coolant. The temperature data may be associated with the temperature of the coolant arriving at the reservoir 108 from the return line 122 and the temperature of the coolant within the reservoir 108. The dispense system 100 may further comprise a data sensor 130 arranged to sense the temperature data. In some embodiments (not shown in FIG. 1), the data sensor 130 may be a single temperature sensor arranged to monitor the temperature of both the coolant return line 122 and coolant in the coolant reservoir 108. In an alternative embodiment, the data sensor 130 may comprises a first temperature sensor 130*a* arranged to monitor the temperature of the coolant from the return line 122 and a second temperature sensor 130*b* arranged to monitor the temperature of the coolant in the coolant reservoir 108.

By controlling the rate of operation of the pump 124 and agitator 114 in response to temperature data associated with both the coolant at or near the point of return to the reservoir 108 (i.e. the return coolant) and the coolant within the reservoir 108 a more efficient response to changes in demand for product from the dispense system 100 can be provided. If, for example, the rate of operation of the pump 124 were to be only controlled in response to the return coolant temperature, a circumstance may exist where a sudden increase in demand for product to be delivered to the dispense location 104 leads to a delay in the appropriate response by the pump 124 and agitator 114 to maintain adequate cooling. If for example, a surge in demand for product causes the flow of product within the product line 112 to suddenly increase, the product may not be sufficiently cooled as it flows through the coolant reservoir 108. This means that the product in the product line 112 will heat up the coolant flow line 120 as it passes through the python 118 to the dispense location 104. The result will be product being dispensed at the incorrect temperature, which should be avoided. If only the temperature of coolant returning to the reservoir 108 is monitored, there will be a delay until the warmed coolant arrives back at the reservoir 108 and the system is able to determine that more cooling is required. There may therefore be a delay of some minutes before the pump 124 (and hence the agitator 114) speed is increased to provide the required rate of heat exchange in the coolant reservoir 108.

The present invention alleviates this problem by controlling the rate of operation of the pump 124 and agitator 114 in response to temperature data associated with both the return coolant and the coolant within the reservoir 108. A change in either can therefore result in a change in the rate of operation of the pump 124 and the agitator 114. If a surge in demand for product were to occur, the control unit 126 is arranged to control the rate of operation of the pump 124 and agitator 114 in response to a change in temperature of the coolant within the reservoir 108, rather than waiting for the associated increase in coolant temperature at the coolant return line 112. This allows the control unit 126 to more quickly respond to an increase in the amount of product flowing through the product line 112.

Due to the response delay described above, the pump 124 may tend to either operate at a maximum or minimum rate. This is because the controller may command a greater than necessary increase in the rate of operation of the pump 124 and agitator 114 in response to a sudden increase in the rate of flow of product through the product line 112. In order to alleviate this problem, the controller of the present invention is arranged to employ a control algorithm in order to more closely match the rate of operation of the pump 124 to the demand for product. The control unit 126 is arranged to vary the rate of operation of the pump 124 and/or the agitator 114 in a range between a maximum rate and a minimum. The rate of operation may be adjusted according to the magnitude of the change in temperature of the coolant. The control algorithm may therefore provide a damping effect in which the response of the control unit 126 to a change in the temperature data is damped to avoid a greater than necessary increase in the rate of operation of the pump 124 and agitator 114. This reduces the energy consumption of the system.

In some embodiments, the controller may provide a freeze point suppressant mode in which the rate of operation of the pump 124 and/or the agitator 114 are modified to account for the presence of freeze point suppressant within the coolant. The freeze point suppressant mode may be selected by the user when a freeze point suppressant, such as Glycol for example, has been added to the coolant (or is used as the coolant). In such embodiments, the temperature of the coolant may be less than 0° C. Furthermore, when a freeze point suppressant is being used, the temperature of coolant returning to the reservoir may be, for example, 3 or 4° C. less than temperatures expected when a freeze point suppressant is not being used. The controller may therefore be arranged to control the rate of operation of the pump 124 and/or the agitator 114 at a first set of predetermined values corresponding to a normal mode in which the coolant does not comprise a freeze point suppressant, and a second set (which is different to the first) of predetermined values corresponding to a freeze point suppressant mode in which the coolant does comprise a freeze point suppressant. The freeze point suppressant mode may in some embodiments provide a sensor temperature offset in order to allow the operation of the pump 124 and/or agitator 124 to be controlled at the second set of predetermined values. The temperature offset may be applied to the temperature data measured by the data sensor 130. In some embodiments, the temperature offset may be applied to the temperature data recorded by the first temperature sensor 130*a* arranged to monitor the temperature of the coolant from the return line 122. In other embodiments, the temperature offset may be applied to the data recorded by the second temperature sensor 130*b*. In some embodiments, the temperature offset may be a subtraction of 3 or 4° C. This is however only one example of the offset that may be applied, in other embodiments any other suitable temperature offset may be chosen according to the properties of the coolant. The freeze point suppressant mode may, in some embodiments, be selected via a user input means.

Figure 2A:
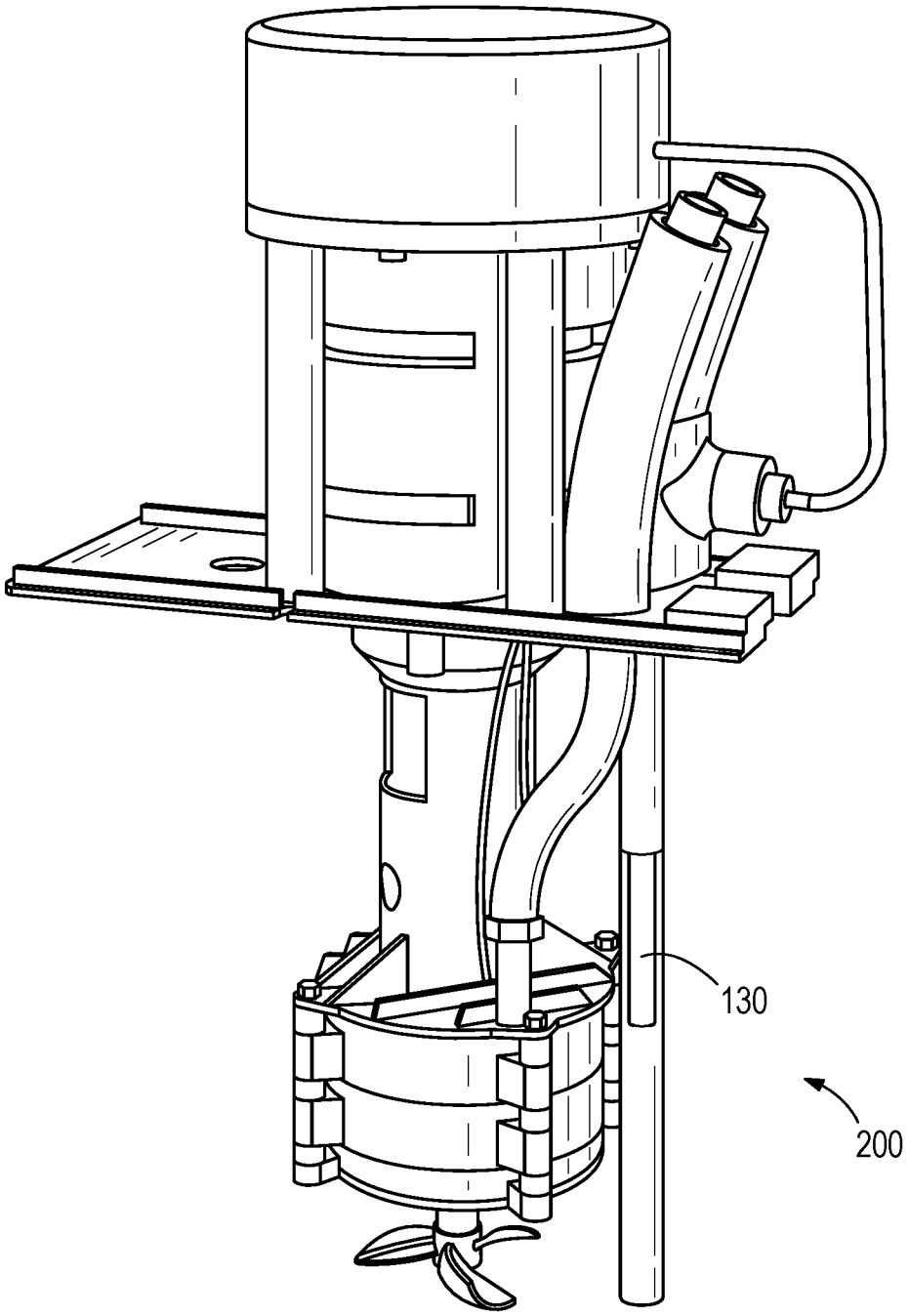
FIG. 2*a* shows a side view of an integrated coolant recirculation apparatus according to one embodiment.
Figure 2B:
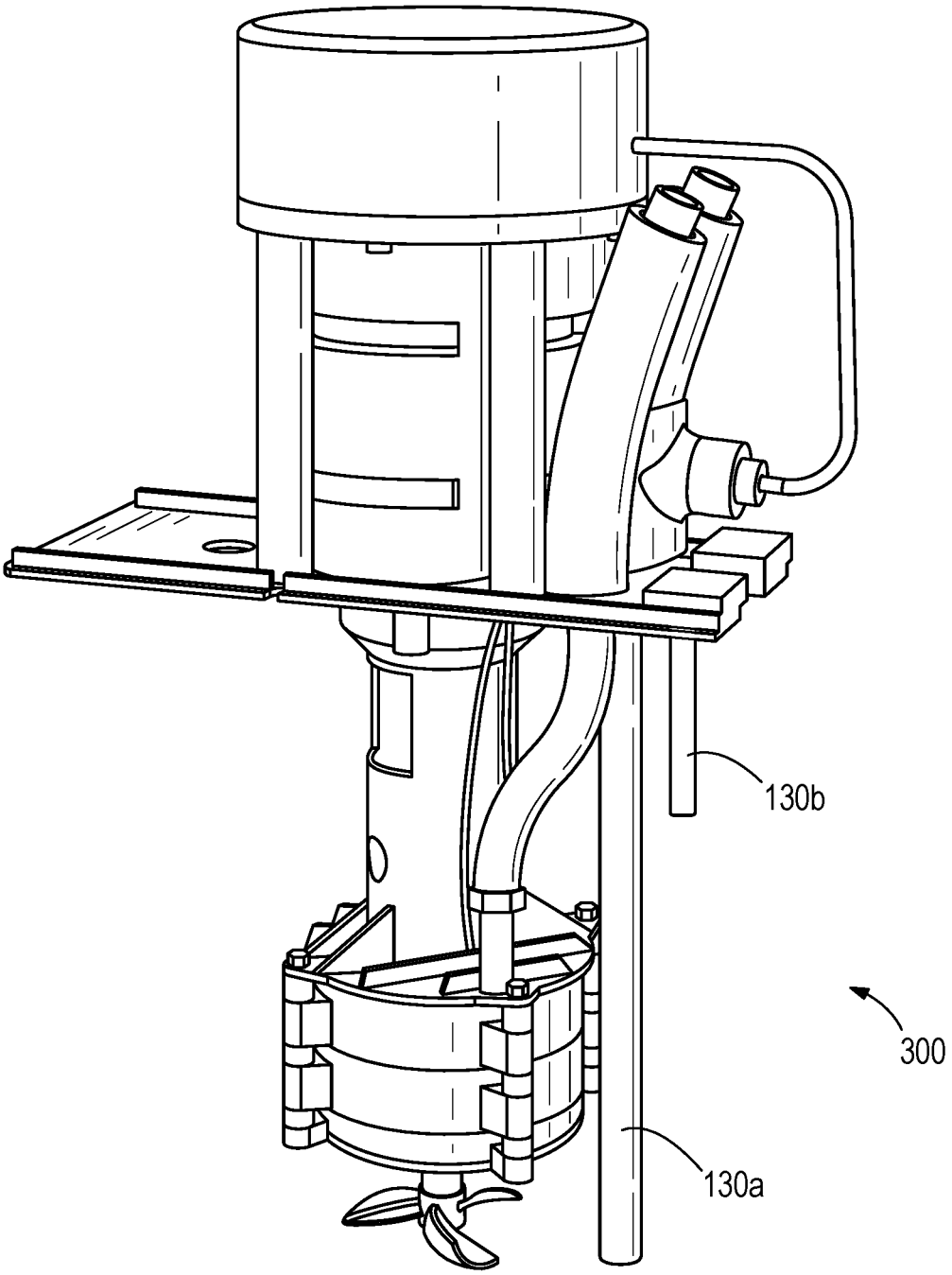
FIG. 2*b* shows a side view of an integrated coolant recirculation apparatus according to one embodiment.
Figure 3:
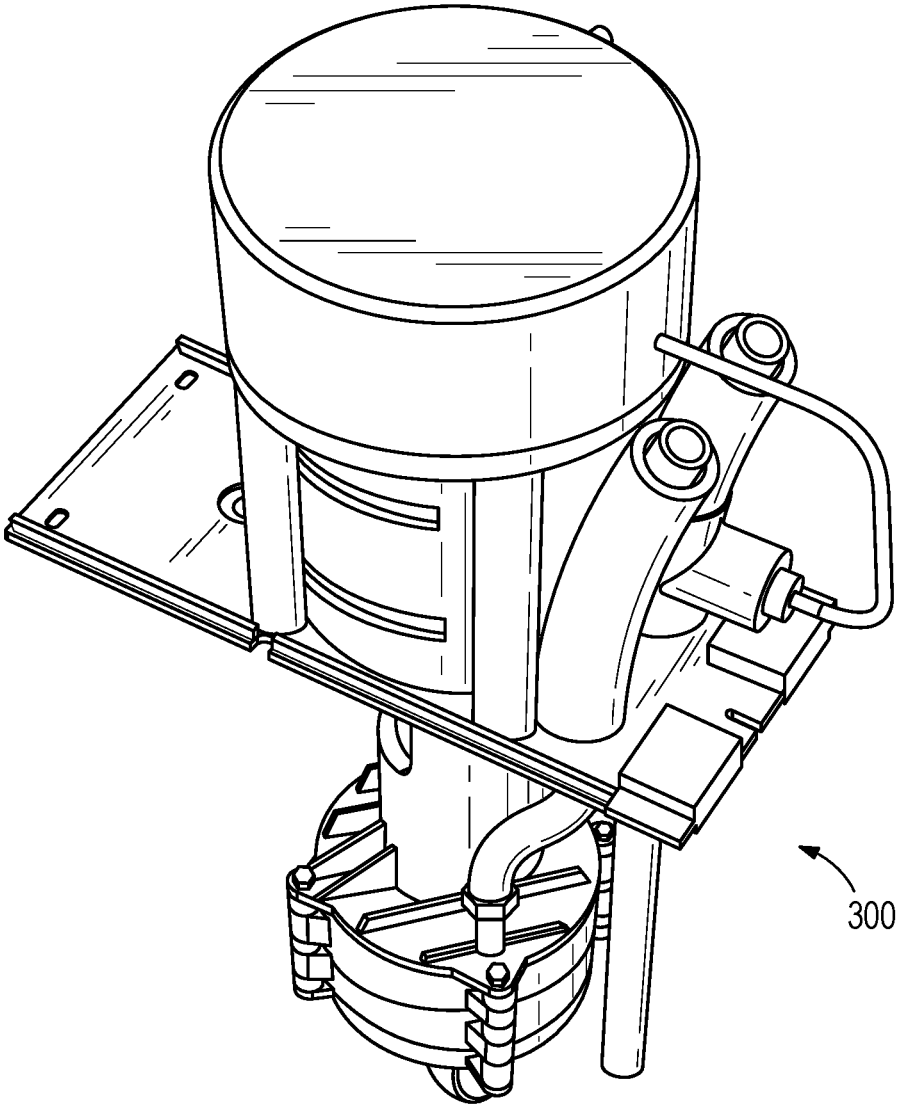
FIG. 3 shows a top view of an integrated coolant recirculation apparatus according to one embodiment.

In some embodiments, the control unit 126, pump 124, agitator 114, motor 116 and data sensor 130 may be provided in an integrated coolant recirculation assembly 200, 300 as shown in FIGS. 2*a*, 2*b* and 3. In the embodiment shown in FIG. 2*a*, the integrated coolant recirculation assembly 200 comprises a single critically located temperature sensor 130 arranged to measure the coolant within the reservoir and the temperature of the coolant returning to the reservoir. In the alternative embodiment shown in FIG. 2*b*, two temperature sensors 130*a*, 130*b* are provided. A first temperature sensor 130*a* is arranged to measure the temperature of the coolant retuning to the reservoir and a second temperature sensor 130*b* within the reservoir. FIG. 3 shows an alternative view of the integrated coolant recirculation assembly 300.

Figure 4:
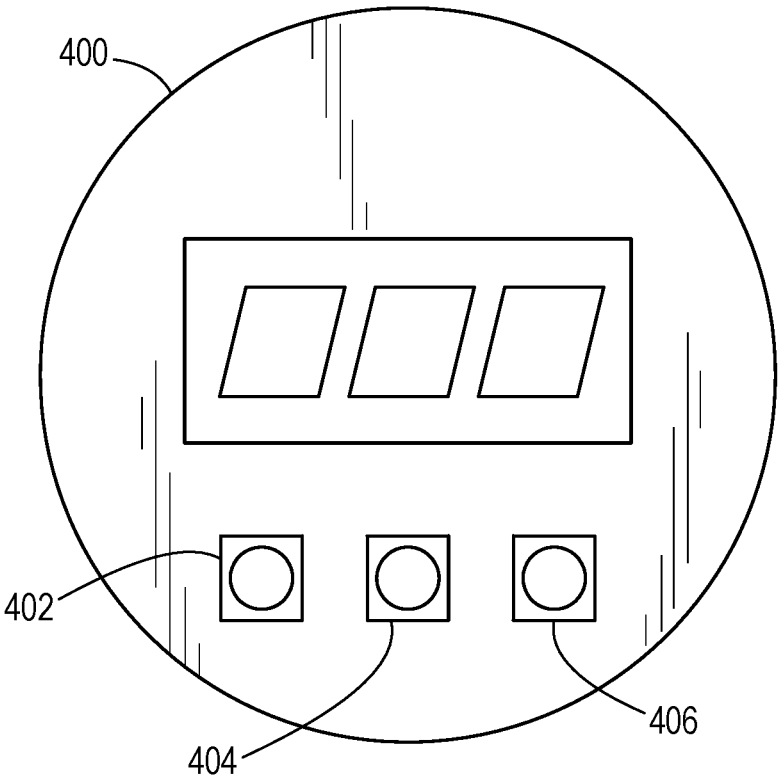
FIG. 4 shows a user input means according to an embodiment of the invention.

An example of a user input means 400 is shown in FIG. 4. In this embodiment, the user input means comprises a control panel having one or more user operable selectors such as buttons or switches forming a keypad to allow the user to select various modes of operation of the controller. The input means 400 may be located on the control unit 126. In the described embodiment, a first selector 402 is arranged to receive a user input to allow the freeze point suppressant mode described above to be selected. A second selector 404 is provided to select the multiple thermally active dispense points mode (i.e. the multiple condensing fonts mode) as described above. In some embodiments, the second selector may be arranged to receive a user input of the number of thermally active dispense points being used, or may be arranged to select the multiple thermally active dispense points mode corresponding to a pre-set number of thermally active dispense points. A third selector 406 may be arranged to allow selection of the idle mode previously described. In some embodiments, additional selectors may be provided to set the timing or duration of the idle mode (e.g. may allow the setting of a timer or calendar function). In other embodiments, any of the first, second or third of the selectors 402, 404, 406 may be omitted, or further selectors may be provided to receive any other user input that may be required.

The integrated coolant recirculation assembly 200, 300 advantageously allows the present invention to be implemented in an existing beverage dispense system. The integrated assembly allows recirculation assembly to be retrofitted to an existing system quickly, safely and with application certainty.

The invention claimed is:

1. A coolant recirculation apparatus for a beverage dispense system, the apparatus comprising:

a pump arranged to recirculate coolant via a coolant circuit from a coolant reservoir to a beverage dispense location having at least one dispense point at which beverage is dispensed;

an agitator mechanism arranged to agitate coolant within the coolant reservoir;

a data sensor arranged to sense temperature data associated with the coolant; and a control unit in communication with the pump, the agitator mechanism and the data sensor, wherein the control unit is arranged to control a rate of operation of the agitator mechanism and the pump in response to the temperature data and according to a predefined property of the beverage dispense system;

wherein the predefined property comprises the number of dispense points that comprise a condensing font.

2. The coolant recirculation apparatus according to claim 1, wherein a change in temperature of either or both of the temperature of the coolant in the coolant reservoir and the temperature of the coolant returning to the coolant reservoir results in a change in the rate of operation of the pump and/or the agitator mechanism.

3. The coolant recirculation apparatus according to claim 1, wherein the control unit is arranged to control the rate of operation of the pump and/or the agitator mechanism according to a control algorithm such that the rate of operation is matched to a change in demand for beverage at the dispense location.

4. The coolant recirculation apparatus according to claim 3, wherein the control algorithm is such that the control unit is arranged to vary the rate of operation of the pump and/or the agitator mechanism in a range between a maximum rate and a minimum rate according to the magnitude of a change in temperature of the coolant.

5. The coolant recirculation apparatus according claim 1, wherein the data sensor comprises a single temperature sensor arranged to sense the temperature of the coolant returning to the coolant reservoir via the coolant circuit.

6. The coolant recirculation apparatus according to claim 1, further comprising a user input means arranged to receive an input specifying the number of condensing fonts attached to coolant circuit.

7. The coolant recirculation apparatus according to claim 6, wherein the user input means comprises a selector switch.

8. A coolant recirculation apparatus for a beverage dispense system, the apparatus comprising:

a pump arranged to recirculate coolant via a coolant circuit from a coolant reservoir to a beverage dispense location having at least one dispense point at which beverage is dispensed;

an agitator mechanism arranged to agitate coolant within the coolant reservoir;

a data sensor arranged to sense temperature data associated with the coolant; and a control unit in communication with the pump, the agitator mechanism and the data sensor, wherein the control unit is arranged to control a rate of operation of the agitator mechanism and the pump in response to the temperature data and according to a predefined property of the beverage dispense system;

wherein the data sensor comprises a first temperature sensor arranged to sense the temperature of the coolant returning to the coolant reservoir via the coolant circuit and a second temperature sensor arranged to sense the temperature of the coolant in the coolant reservoir.

9. The coolant recirculation apparatus according to claim 8, wherein the control unit is arranged to control the operation of the pump such that a threshold coolant pressure is provided in the coolant circuit.

10. The coolant recirculation apparatus according to claim 9, wherein the threshold pressure is sufficient to provide cooling to a condensing surface of each condensing font.

11. The coolant recirculation apparatus according to claim 8, wherein the control unit is responsive to input of the number of condensing fonts attached to the cooling circuit to adjust the operation of the pump to provide cooling to all the condensing fonts attached to the cooling circuit.

12. The coolant recirculation apparatus according to claim 11, wherein pump speed is adjustable in response to user selection of the number of condensing fonts to provide cooling to all the condensing fonts attached to the cooling circuit.

13. The coolant recirculation apparatus according to claim 8, wherein the control unit is arranged to provide an idle mode.

14. The coolant recirculation apparatus according to claim 13, wherein in the idle mode the coolant in the coolant circuit is sufficient to maintain beverage cooling.

15. The coolant recirculation apparatus according to claim 14, wherein in the idle mode the pump, the agitator mechanism or both are operated at a predetermined minimum rate.

16. The coolant recirculation apparatus according to claim 13, further comprising a user input means in communication with the control unit, the user input means arranged to receive an input selecting the idle mode.

17. The coolant recirculation apparatus according to claim 13, wherein the control unit is arranged to activate the idle mode at a predetermined time.

18. The coolant recirculation apparatus according to claim 13, wherein the control unit is arranged to provide a freeze point suppressant mode in which the rate of operation of the agitator mechanism and the pump are modified to account for the presence of a freeze point suppressant within the coolant.

19. The coolant recirculation apparatus according to claim 18, wherein control unit is arranged to control the rate of operation of the agitator mechanism and the pump at: a first set of predetermined values corresponding to a normal mode in which the coolant does not comprise a freeze point suppressant; and a second set of predetermined values corresponding to the freeze point suppressant mode in which the coolant does comprise a freeze point suppressant.

20. The coolant recirculation apparatus according to claim 19, wherein the freeze point suppressant mode is arranged to apply an offset to the temperature data in order to allow the operation of the agitator mechanism and the pump to be controlled at the second set of predetermined values.

21. The coolant recirculation apparatus according to claim 18, further comprising a user input means arranged to receive an input selecting the freeze point suppressant mode.

22. A coolant recirculation apparatus for a beverage dispense system, the apparatus comprising:

a pump arranged to recirculate coolant via a coolant circuit from a coolant reservoir to a beverage dispense location having at least one dispense point at which beverage is dispensed;

a data sensor arranged to sense temperature data associated with the coolant; and a control unit in communication with the pump and the data sensor, wherein the control unit is arranged to control the rate of operation of the pump in response to the temperature data and according to a predefined property of the beverage dispense system;

wherein the predefined property comprises the number of dispense points that comprise a condensing font.

23. The coolant recirculation apparatus according to claim 22, further comprising a user input means that receives an input specifying the number of condensing fonts attached to coolant circuit.

24. The coolant recirculation apparatus according to claim 23, wherein the user input means comprises a selector switch.

25. The coolant recirculation apparatus according to claim 22, wherein the control means controls the operation of the pump such that a threshold coolant pressure is provided in the coolant circuit.

26. The coolant recirculation apparatus according to claim 25, wherein the threshold pressure is sufficient to provide cooling to a condensing surface of the condensing font.

27. The coolant recirculation apparatus according to claim 23, wherein the control means is responsive to input of the number of condensing fonts attached to the cooling circuit to adjust the operation of the pump to provide cooling to all the condensing fonts attached to the cooling circuit.

28. The coolant recirculation apparatus according to claim 27, wherein a pump speed of the pump is adjustable in response to the number of condensing fonts inputted to provide cooling to all the condensing fonts attached to the cooling circuit.

29. The coolant recirculation apparatus according to claim 22, wherein the control unit provides a freeze point suppressant mode in which the rate of operation of the agitator mechanism and the pump are modified to account for the presence of a freeze point suppressant within the coolant.

30. The coolant recirculation apparatus according to claim 29, wherein control unit controls the rate of operation of the agitator mechanism and the pump at: a first set of predetermined values corresponding to a normal mode in which the coolant does not comprise a freeze point suppressant; and a second set of predetermined values corresponding to the freeze point suppressant mode in which the coolant does comprise a freeze point suppressant.

31. The coolant recirculation apparatus according to claim 30, wherein the freeze point suppressant mode is arranged to apply an offset to the temperature data in order to allow the operation of the agitator mechanism and the pump to be controlled at the second set of predetermined values.

32. The coolant recirculation apparatus according to claim 31, further comprising a user input means arranged to receive an input selecting the freeze point suppression mode.

33. The coolant recirculation apparatus according to claim 22, further including an agitator mechanism that agitates coolant within the coolant reservoir.

34. The coolant recirculation apparatus according to claim 33, wherein the pump and the agitator mechanism are combined.

35. The coolant recirculation apparatus according to claim 34, wherein the pump and the agitator mechanism are driven by a common motor.

36. The coolant recirculation apparatus according to claim 35, wherein the pump and the agitator mechanism are separate.

37. The coolant recirculation apparatus according to claim 36, wherein the pump and the agitator mechanism are driven by separate motors.

38. A coolant recirculation apparatus for a beverage dispense system, the apparatus comprising:

a pump that recirculates coolant via a coolant circuit from a coolant reservoir to a beverage dispense location having at least one dispense point at which beverage is dispensed;

an agitator mechanism that agitates the coolant within the coolant reservoir; and a data sensor that senses temperature data associated with the coolant;

wherein the pump operates at a rate of operation in response to the temperature data and according to a predefined property of the beverage dispense system; and wherein the data sensor comprises a first temperature sensor that senses the temperature of the coolant returning to the coolant reservoir via the coolant circuit and a second temperature sensor that senses the temperature of the coolant in the coolant reservoir.

39. A coolant recirculation apparatus for a beverage dispense system, the apparatus comprising:

a pump that recirculates coolant via a coolant circuit from a coolant reservoir to a beverage dispense location having at least one dispense point at which beverage is dispensed;

an agitator mechanism that agitates the coolant within the coolant reservoir; and a data sensor that senses temperature data associated with the coolant;

wherein the pump operates at a rate of operation in response to the temperature data and according to a predefined property of the beverage dispense system; and wherein the predefined property comprises the number of dispense points that comprise a condensing font.

40. A coolant recirculation apparatus for a beverage dispense system, the apparatus comprising:

a pump that recirculates coolant via a coolant circuit from a coolant reservoir to a beverage dispense location having at least one dispense point at which beverage is dispensed; and a data sensor that senses temperature data associated with the coolant;

wherein the pump operates at a rate of operation in response to the temperature data and according to a predefined property of the beverage dispense system; and wherein the predefined property comprises the number of dispense points that comprise a condensing font.

* * * * *